US009027988B2

(12) United States Patent
Olivieri et al.

(10) Patent No.: US 9,027,988 B2
(45) Date of Patent: May 12, 2015

(54) STRIKER DEVICE FOR A MOTOR VEHICLE DOOR LOCK AND A MOTOR VEHICLE EQUIPPED WITH SUCH STRIKER DEVICE

(71) Applicant: Fiat Group Automobiles S.p.A., Turin (IT)

(72) Inventors: Carlo Olivieri, Turin (IT); Marilisa Quaresima, Turin (IT)

(73) Assignee: Fiat Group Automobiles S.p.A., Turin (IT)

( * ) Notice: Subject to any disclaimer, the term of this patent is extended or adjusted under 35 U.S.C. 154(b) by 0 days.

(21) Appl. No.: 14/024,413

(22) Filed: Sep. 11, 2013

(65) Prior Publication Data

US 2014/0008939 A1 Jan. 9, 2014

(30) Foreign Application Priority Data

Sep. 12, 2012 (EP) ..... 12425150

(51) Int. Cl.

| | |
|---|---|
| ***E05B 15/02*** | (2006.01) |
| ***E05B 65/12*** | (2006.01) |
| ***E05B 85/04*** | (2014.01) |
| *E05B 17/00* | (2006.01) |

(52) U.S. Cl.

CPC ..... *E05B 15/025* (2013.01); *E05B 85/04* (2013.01); *E05B 85/045* (2013.01); *E05B 17/0062* (2013.01); *E05B 15/024* (2013.01)

(58) Field of Classification Search

USPC ..... 296/146.8, 149, 187.12, 197.03, 296/187.03, 202

See application file for complete search history.

(56) References Cited

U.S. PATENT DOCUMENTS

| | | | | |
|---|---|---|---|---|
| 5,626,384 | A * | 5/1997 | Walther | 296/155 |
| 6,324,948 | B1 * | 12/2001 | Kavc et al. | 81/484 |
| 6,425,300 | B1 * | 7/2002 | Seo | 73/865.9 |
| 7,097,219 | B2 * | 8/2006 | Paskonis | 292/340 |
| 7,784,852 | B2 * | 8/2010 | Fannon et al. | 296/146.9 |
| 8,517,450 | B2 * | 8/2013 | Lange | 296/146.6 |
| 2009/0322119 | A1 * | 12/2009 | Fannon et al. | 296/146.9 |
| 2010/0253116 | A1 * | 10/2010 | Lange | 296/202 |
| 2011/0210576 | A1 * | 9/2011 | Fischer et al. | 296/155 |

FOREIGN PATENT DOCUMENTS

| | | |
|---|---|---|
| EP | 1 182 311 A1 | 2/2002 |
| EP | 1 881 136 A1 | 1/2008 |
| FR | 2 772 819 A1 | 6/1999 |

* cited by examiner

*Primary Examiner* — Glenn Dayoan
*Assistant Examiner* — Sunsurraye Westbrook
(74) *Attorney, Agent, or Firm* — Dickstein Shapiro LLP

(57) ABSTRACT

A striker device for a motor vehicle door lock having a striker and an element made of a plastic material and equipped with a plate, which is suitable for being placed against a wall of the motor vehicle and is coupled to the striker in fixed relative position; the element has a plurality of tongues, which protrude from the plate in the opposite direction to the striker and are arranged in positions so as to engage, in use, the edges of two apertures in the wall of the motor vehicle, to keep the plate in a fixed reference position during a first fitting step; the tongues are breakable to enable changing the position of the striker device with respect to the wall of the motor vehicle in a possible second fitting step.

11 Claims, 3 Drawing Sheets

STRIKER DEVICE FOR A MOTOR VEHICLE DOOR LOCK AND A MOTOR VEHICLE EQUIPPED WITH SUCH STRIKER DEVICE

The present invention relates to a striker device for a motor vehicle door lock.

BACKGROUND OF THE INVENTION

On motor vehicles, each door has a lock, which engages an associated striker device when it is closed. In some known solutions, the striker device comprises: a striker made of a metal material; a plate made of a plastic material, inserted between the striker and a pillar of the motor vehicle; and two screws for fastening the striker to the pillar.

During assembly, it is usually necessary to slightly adjust the position of the striker, in order to ensure the correct relative positioning between striker and lock and therefore precise and secure closing of the door. To carry out this adjustment, the two screws are loosened so that the optimal position for the striker can be found and then tightened again. As a rule, the plate remains fixed with respect to the pillar during striker adjustment.

The striker device just described is not very satisfactory because, after adjustment, the striker is no longer centred with respect to the underlying plate, to the detriment of the motor vehicle aesthetic appearance.

In another known solution, shown in FIG. 2 of EP1881136A1 and corresponding to the preamble of claim 1, the striker is fastened with respect to the plate. At the same time, the plate is provided with two rear appendages that can slide with a certain amount of play in respective apertures to adjust the position of the striker. This solution is unsatisfactory in the initial phase of fitting as the plate must be held on the pillar by hand to be able to screw in the two screws.

SUMMARY OF THE INVENTION

The object of the present invention is to provide a striker device for a motor vehicle door lock that enables the above-described drawbacks to be resolved in a simple and inexpensive manner.

According to the present invention, a striker device for a motor vehicle door lock is provided, as defined in claim 1.

In addition, according to the present invention, a motor vehicle is provided as defined in claim 8 and an assembly method is provided as defined in claim 11.

BRIEF DESCRIPTION OF THE DRAWINGS

For a better understanding of the present invention, a preferred embodiment will now be described, purely by way of a non-limitative example and with reference to the attached drawings, where.

DETAILED DESCRIPTION OF THE INVENTION

Figure 1:
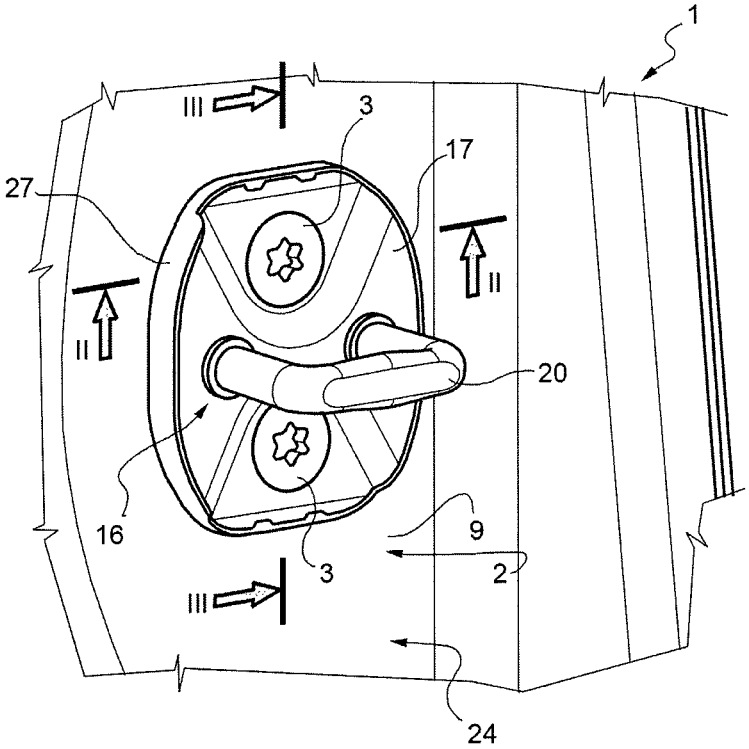
FIG. 1 is a partial perspective view of a striker device for a motor vehicle door lock according to the present invention.
Figure 3:
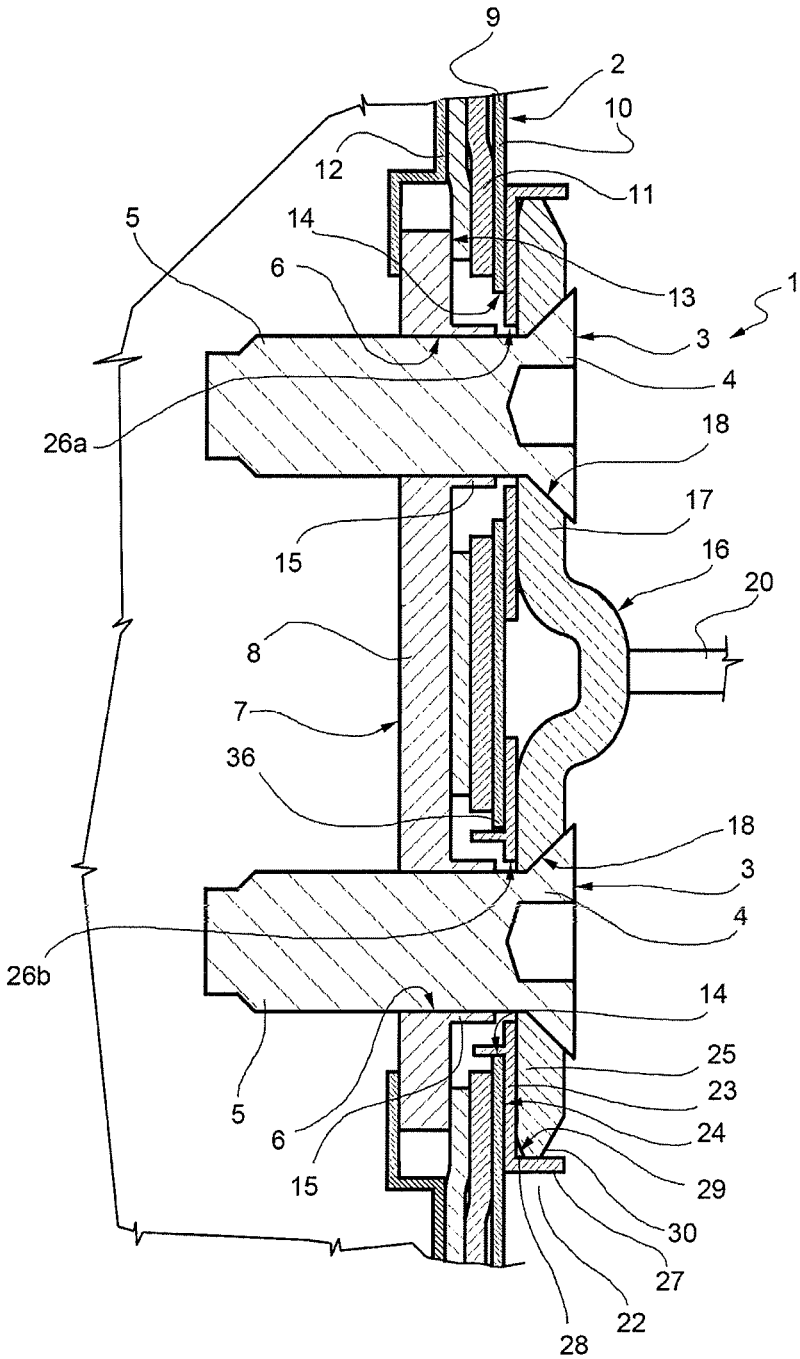

In FIG. 1, reference numeral 1 indicates, as a whole, a striker device for a door lock (not shown). With reference to FIG. 3, the device 1 is fixed to a pillar 2 of a motor vehicle (partially shown) by two screws 3, which comprise respective heads 4 and respective shanks 5. The shanks 5 are screwed into respective threaded holes 6, preferably made in a single body 7, having a plate 8 positioned behind a wall 9 of the pillar 2.

Preferably, the wall 9 comprises an outer sheet metal panel or side panel 10 and a stiffener 11 arranged between the outer sheet metal 10 and the plate 8. In addition, in the embodiment shown, the pillar 2 comprises a cage 12, which is fastened to the wall 9 in a manner not described in detail and holds a front surface 13 of the plate 8 at a substantially fixed distance from the wall 9, whilst leaving a certain freedom of movement so that the body 7 can float parallel to surface 13.

The wall 9 has two apertures 14, through which the shanks 5 and respective collars 15 pass with radial play in all directions, the latter constituting part of the body 7 and protruding from front surface 13.

The device 1 comprises a striker 16 of known type, preferably made of a metal material and comprising, in turn, a base 17 having two holes 18, with screw guides engaged by the heads 4. The striker 16 also comprises a coupling element 20, which has a U-shape and is fastened at its ends to the base 17 to form a closed ring suitable for being engaged by the lock of the door when the latter is closed.

The device 1 further comprises an element 22, made in a single piece from a plastic material and comprising, in turn, a plate 23, which is flat, substantially parallel to front surface 13, is placed against an outer front surface 24 of the wall 9 and has a flat face 25 against which the base 17 rests.

The plate 23 has an upper hole 26*a* and a lower hole 26*b*, which are pass-through, are coaxial with holes 18 and through which the shanks 5 of the screws 3 pass.

In addition, the element 22 comprises a projection 27, which extends along the external edge 28 of plate 23 and projects with respect to the face 25 so as to delimit, together with the face 25, a housing 29. The housing 29 houses the base 17 and is sized so as not to leave freedom of movement for the base 17 parallel to the face 25. Preferably, the projection 27 extends uninterruptedly along the external edge 28 and so completely covers up the external edge 30 of the base 17.

Figure 5:
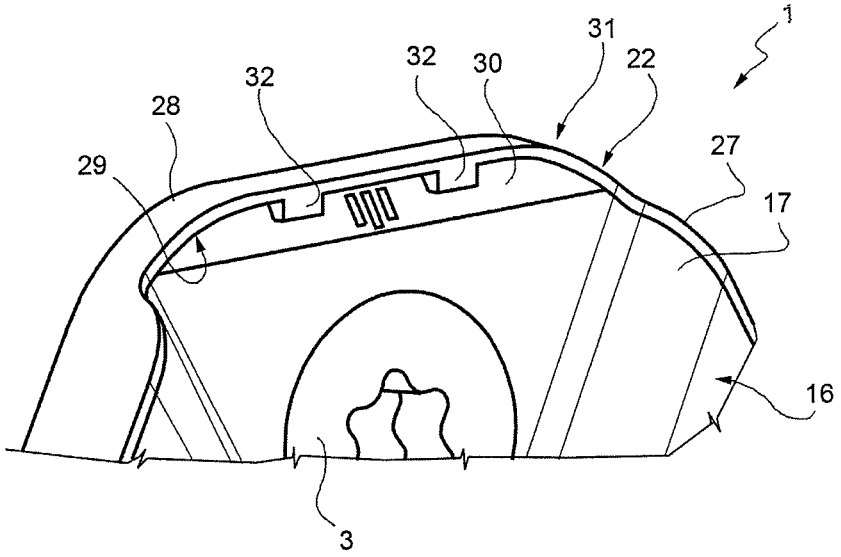
FIG. 5 is an enlargement of a detail in FIG. 1.

With reference to FIG. 5, the projection 27 constitutes part of an attachment system 31 for holding the striker 16 coupled in a fixed position to plate 23, or rather without relative movements in any operating condition. The attachment system 31 also comprises a plurality of teeth 32, which protrude from the projection 27 and snap-fit to the external edge 30 to hold the base 17 against the face 25.

Figure 2:
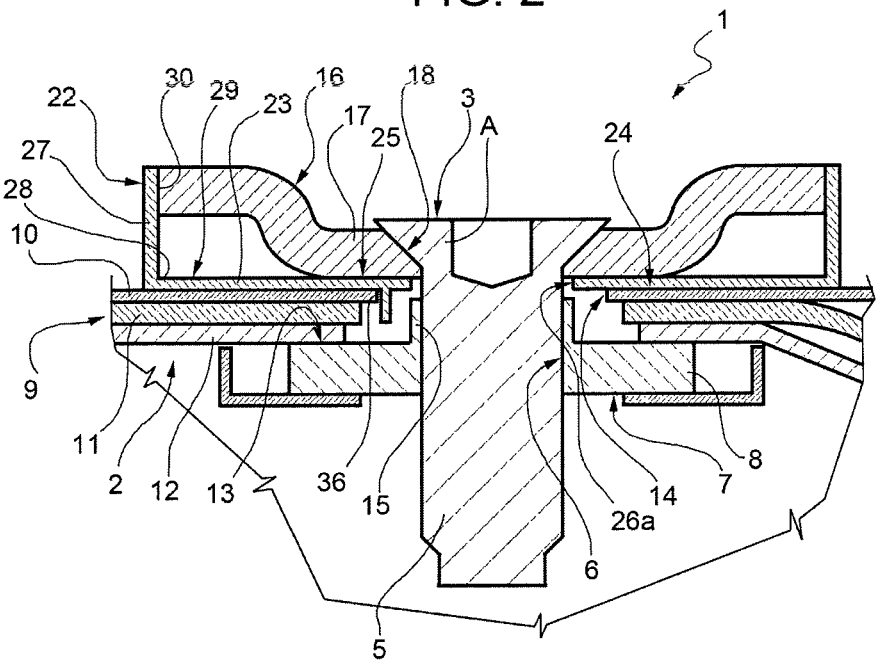
FIGS. 2 and 3 are cross-sections along the lines II-II and respectively, in FIG. 1, on an enlarged scale.
Figure 4:
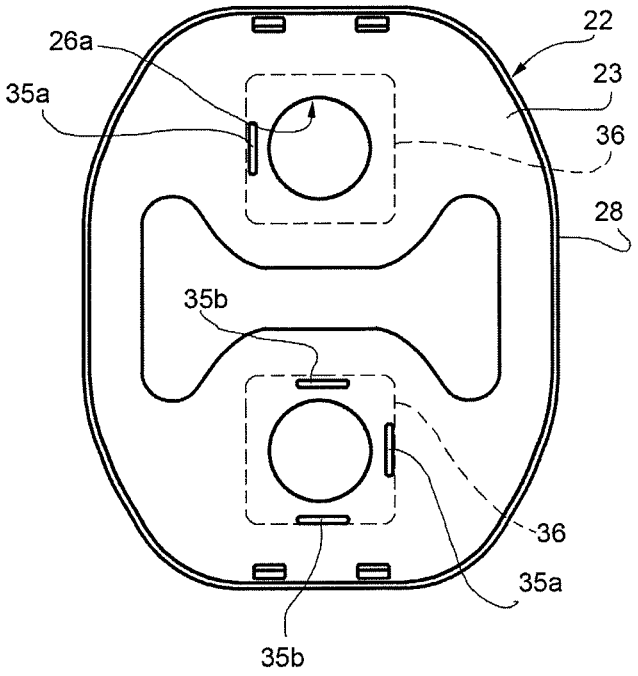
FIG. 4 is a rear view of a detail of the device in FIG. 1.

As shown in FIG. 4, the element 22 also comprises a plurality of tongues, which protrude from plate 23 in the opposite direction to the projection 27 and engage the apertures 14. According to one aspect of the present invention, the tongues are arranged in positions so as to engage the edges 36 of the apertures 14 (FIGS. 2 and 3) and keep plate 23 in a fixed reference position with respect to the wall 9 when the screws 3 need to be inserted through holes and screwed into the threaded holes 6 when fitting the device 1 on the pillar 2.

The tongues are flat, orthogonal to plate 23 and parallel to two mutually transversal ideal planes. At the same time, the edges 36 have a polygonal profile, preferably square and, if necessary, with rounded vertices.

In particular, four tongues are provided: two are indicated by reference numeral 35*a* and are vertical and horizontally spaced apart; the other two are indicated by reference numeral 35*b* and are substantially horizontal and are vertically spaced apart. In particular, tongues 35*a* are vertically staggered, as one is adjacent to hole 26*a*, while the other is adjacent to hole 26*b*. Instead, tongues 35*b* are arranged on opposite sides of hole 26*b*.

According to a further aspect of the present invention, tongues 35*a* and 35*b* can be broken and therefore separated from plate 23 to permit free translation of plate 23 on surface 24 when the screws 3 are loosened, in order to adjust the position of the element 22 and consequently of the striker 16 with respect to the wall 9, before finally tightening the screws 3 in the threaded holes 6. To make the tongues 35*a* and 35*b* breakable, their cross-section is relatively small with respect to that of the plate 23 and/or weakened areas are provided near the connection zones with the plate 23.

During the fitting of the device 1 on the pillar 2, the device 1 is first placed on the wall 9 by inserting tongues 35*a* and 35*b* into the apertures 14, along the edges 36. Placing the tongues 35*a* and 35*b* against the edges 36 enables keeping the device 1 in a fixed reference position with respect to the wall 9. The shanks 5 are then inserted through holes 18, holes 26*a* or 26*b* and into the threaded holes 6. The end of the shanks 5 has a smaller diameter than the remainder, or has a pointed shape (FIG. 3), to facilitate entry of the shanks 5 into the threaded holes 6, notwithstanding possible misalignment of the threaded holes 6 due to the floating capacity of the body 7.

The screws 3 are then screwed in and tightened to lock the device 1 in the above-stated reference position. At this point, tests are carried out to check the latching operation of the lock with the striker 16 and thus the functioning of door closure. If the tests give negative results, the position of the striker 16 must be adjusted. To this end, the screws 3 are loosened and at least some of the tongues 35*a* and 35*b* are then broken to give freedom of movement to the device 1.

In particular, the screws 3 remain connected in their respective threaded holes 6, even when breaking the tongues 35*a* and 35*b*, and so the body 7 can follow the adjustment movement of the device 1.

Preferably, the device 1 is not moved away from surface 24 to break the tongues 35*a* and 35*b*, but is made to slide on surface 24 with force. When this movement is imposed, at least some of the tongues 35*a* and 35*b* bend and break, as the sides of the edges 36 perform the function of blades that cut the tongues 35*a* and 35*b*. In particular, if only tongues 35*a* are broken, the straight horizontal sides of the edges 36 can guide tongues 35*b* and, consequently, the horizontal translation of the device 1.

Once a new position for the device 1 is determined, the screws 3 are tightened and the door closing operation is checked again. If the new position is unsatisfactory, further tests are carried out (loosening the screws 3, moving the device 1 with the body 7 and tightening the screws 3 again) until an optimal position for the device 1 is achieved.

From the foregoing, it is evident that the tongues 35*a* and 35*b* enable placing the device 1 in a fixed reference position during fitting and the first tightening of the screws 3, without having to hold the device 1 against the surface 24 by hand, while, at the same time, as they are breakable, they do not obstruct the possibility of adjusting the position of the device 1.

The particular arrangement of the tongues 35*a* and 35*b* enables the stability of the device 1 to be optimized during fitting and the first tightening of the screws 3.

At the same time, the striker 16 and the element 22 are adjusted together, or rather they remain in the same relative position in any operating condition, and so the aesthetic appearance of the pillar 2 is optimal even after adjusting the position of the device 1.

The aesthetic appearance of the device 1 is also optimal thanks to the projection 27, which hides or protects the external edge 30 of the base 17. At the same time, the projection 27 offers good retaining capacity for the base 17, also thanks to the presence of teeth 32.

In conclusion, it appears evident from the foregoing that modifications and variations can be applied to the device 1 described and illustrated herein without leaving the scope of protection of the present invention, as defined in the appended claims.

In particular, the shape and number of the tongues 35*a* and 35*b* and the shape of the apertures 14 could be different from those indicated by way of example.

In addition, the striker 16 could be secured with respect to the plate 23 in a different manner from that of the described attachment system 31.

Furthermore, the body 7 could be substituted by two separate parts, each one having an associated threaded hole 6; and/or the cage 12 could be absent; and/or a single rectangular aperture could be provided instead of the two apertures 14.

Finally, the device 1 could be connected not just to a pillar, but also to other body elements of the motor vehicle (for example, for closing a boot lid).

The invention claimed is:

1. A striker device for a motor vehicle door lock, the device comprising:

a striker for a door lock, the striker having a pair of first holes; and an element comprising:

a) a plate suitable for being placed against a wall of the motor vehicle and having a pair of second holes respectively coaxial with said first holes;

b) attachment means for coupling said plate to said striker in a fixed relative position;

c) a plurality of tongues, which protrude from said plate in the opposite direction to said striker so as to engage, in use, at least one aperture in said wall;

wherein said tongues are arranged in positions so as to engage, in use, the edges of said aperture and keep said plate in a fixed reference position, and wherein said tongues are breakable with respect to said plate to change, if necessary, the position of the striker device with respect to said wall.

2. A device according to claim 1, wherein said striker comprises a base resting on said plate; and in that said element comprises a projection that protrudes from an external edge of said plate and is arranged around at least part of said base.

3. A device according to claim 2, wherein said plate and said projection define a seat, which is engaged by said base, substantially without play parallel to said plate.

4. A device according to claim 2, wherein said attachment means comprise at least one tooth that projects from said projection and is snap-fitted to said base.

5. A device according to claim 1, wherein said tongues are flat and parallel to two transversal ideal planes.

6. A device according to claim 5, wherein said tongues are four in number and are defined by:

two vertical tongues horizontally separated from each other and arranged on opposite sides of said second holes;

two substantially horizontal tongues vertically separated from each other and arranged on opposite sides of at least one of said second holes.

7. A device according to claim 6, wherein said vertical tongues are vertically staggered from each other.

8. A motor vehicle comprising:

a wall having at least one aperture;

a striker device placed on a front surface of said wall and made according to claim 1;

female thread means arranged behind said wall;

two screws, which engage said first and second holes, engage said aperture with radial play, and are screwed into said female thread means;

said female thread means being able to float when said screws are loosened.

9. A motor vehicle according to claim 8, wherein said radial play is in all directions.

10. A motor vehicle according to claim 9, wherein the edges of said apertures comprise straight sides, which can guide some of said tongues along a direction when the remainder has/have been broken.

11. An assembly method for fitting a striker device made according to claim 1 on a wall having at least one aperture, the method comprising the steps of:

placing the striker device in a fixed reference position by inserting said tongues in said aperture, in contact with the edges of said aperture;

fastening said striker device to said wall, by inserting two screws through said striker device and said aperture, and tightening said screws in floating female screw means arranged behind said wall;

performing a functional test on the locking of a door lock; if the functional test fails, adjusting the position of said striker device by carrying out the following operations:

a) loosening said screws;

b) breaking at least one of said tongues;

c) moving said striker device;

d) tightening said screws again;

e) repeating the functional test.

* * * * *